US010218110B2

(12) United States Patent
Wakimoto

(10) Patent No.: US 10,218,110 B2
(45) Date of Patent: Feb. 26, 2019

(54) SEAL COVER

(71) Applicant: Sumitomo Wiring Systems, Ltd., Yokkaichi, Mie (JP)

(72) Inventor: Isao Wakimoto, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/772,847

(22) PCT Filed: Oct. 26, 2016

(86) PCT No.: PCT/JP2016/081703

§ 371 (c)(1),
(2) Date: May 2, 2018

(87) PCT Pub. No.: WO2017/082052

PCT Pub. Date: May 18, 2017

(65) Prior Publication Data

US 2018/0316123 A1 Nov. 1, 2018

(30) Foreign Application Priority Data

Nov. 11, 2015 (JP) ..... 2015-221082

(51) Int. Cl.
*H01R 13/52* (2006.01)
*H01R 13/6581* (2011.01)
*H01R 13/512* (2006.01)

(52) U.S. Cl.
CPC ..... *H01R 13/5202* (2013.01); *H01R 13/512* (2013.01); *H01R 13/5213* (2013.01); *H01R 13/6581* (2013.01); *H01R 2201/26* (2013.01)

(58) Field of Classification Search
CPC ..... H01R 13/5202
See application file for complete search history.

(56) References Cited

U.S. PATENT DOCUMENTS 9,362,653 B2 * 6/2016 Tanaka ..... H01R 13/713
9,865,958 B2 * 1/2018 Beischer ..... H01R 13/506
(Continued)

FOREIGN PATENT DOCUMENTS

JP 2012-238422 12/2012
JP 2012-252858 12/2012
JP 2013-26078 2/2013

OTHER PUBLICATIONS

International Search Report dated Jan. 24, 2017.

*Primary Examiner* — James Harvey
(74) *Attorney, Agent, or Firm* — Gerald E. Hespos; Michael J. Porco; Matthew T. Hespos

(57) ABSTRACT

A seal cover (40) is mounted on a shield connector (20) of a device case (10) and includes a cover body (41), a second sealing member (43), a shield shell (51) and shell fixing bolts (B) that are inserted through third bolt insertion holes (55) of the shield shell (51) with clearances (C1) between the shell fixing bolts (B) and edges of the third bolt insertion holes (55). The cover body (41) includes a restricting protrusion (48) that is inserted through a restricting hole of the shield shell (51) with a clearance (C2) defined between the restricting protrusion (48) and an edge of the restricting hole (58). The size of the clearance (C2) is such that the restricting protrusion (48) does not contact the edge of the restricting hole (58) even if the shield shell (51) rotates as the shell fixing bolt (B) is tightened.

2 Claims, 4 Drawing Sheets

(56) References Cited

U.S. PATENT DOCUMENTS

| | | | | |
|---|---|---|---|---|
| 2012/0279747 | A1* | 11/2012 | Sella | H02G 3/083 174/59 |
| 2012/0285718 | A1 | 11/2012 | Sakakura | |
| 2014/0113489 | A1 | 4/2014 | Tanaka et al. | |
| 2014/0377978 | A1 | 12/2014 | Okamoto et al. | |
| 2016/0056565 | A1* | 2/2016 | Yamada | H01R 13/5213 439/521 |

* cited by examiner

SEAL COVER

BACKGROUND

Field of the Invention

This specification relates to a seal cover.

Description of the Related Art

An electrical device installed in a vehicle is accommodated in a case, and the case includes a connector mounted on an external wall for connection of the electrical device and an external device. The connector has an opening for an external connecting operation. A seal cover is mounted on the connector to close the opening when the connecting operation is not performed. Japanese Unexamined Patent Publication No. 2013-026078 discloses a seal cover with a service cover to be fit to a connector and a shield shell for covering this service cover.

To prevent erroneous mounting, the service cover includes an engaging projection and the shield shell includes an engaging hole for receiving this engaging projection when the service cover is mounted in a correct orientation on the shield shell. If an attempt is made to mount the service cover in a wrong orientation on the shield shell, the engaging projection interferes with the shield shell and the service cover cannot be mounted.

The shield shell includes a fastening piece having a bolt insertion hole, and the seal cover is fixed to the case by inserting a bolt through a bolt insertion hole and screwing the bolt into a screw hole provided in the case.

A seal ring is mounted on the outer periphery of the service cover for shutting off water between the connector and the service cover. A squeezing amount of the seal ring needs to be uniform over the entire circumference to ensure good sealing in the seal cover. To that end, high fitting accuracy is required between the service cover and the connector.

SUMMARY

A seal cover is mounted on a case having the opening, and includes a cover body for closing the opening. A sealing member is mounted on the case for sealing between the cover body and the case. A covering member is assembled with and covers the cover body, and a bolt fixes the covering member to the case. The covering member includes a bolt insertion hole through which the bolt is inserted so that a first clearance is defined between the bolt and an edge of the bolt insertion hole. One of the cover body and the covering member includes an engaging protrusion and the other includes an engaging hole for receiving the engaging protrusion. The engaging protrusion is inserted in the engaging hole with a second clearance defined between the engaging protrusion and an edge of the engaging hole, the size of the second clearance is set such that the engaging protrusion does not come into contact with the edge of the engaging hole even if the covering member rotates as the bolt is tightened.

There may be position tolerances between the bolt insertion hole provided in the covering member and a bolt hole provided in the case and having the bolt screwed therein. To absorb these position tolerances, the bolt is inserted with the first clearance defined between the bolt and the edge of the bolt insertion hole in the seal cover disclosed in this specification. However, due to the presence of the first clearance, the covering member may rotate together with the rotation of the bolt when tightening the bolt. If the engaging protrusion comes into contact with the edge of the engaging hole as the covering member rotates, the cover body rotates and a strong compressive force is applied locally to the sealing member so that sealing capability may be reduced.

Accordingly, the seal cover disclosed in this specification is configured so that the size of the second clearance between the engaging protrusion and the edge of the engaging hole is set such that the engaging protrusion does not contact the edge of the engaging hole even if the covering member rotates. This suppresses the rotation of the cover body together with the covering member and suppresses a reduction of sealing capability due to local compression of the sealing member.

In the above seal cover, the second clearance may be larger than the first clearance. Thus, the engaging protrusion does not contact the edge of the engaging hole even if the covering member rotates. As a result, sealing capability is not reduced due to local compression of the sealing member.

According to this specification, it is possible to provide a seal cover capable of ensuring high sealing capability.

DETAILED DESCRIPTION

Figure 1:
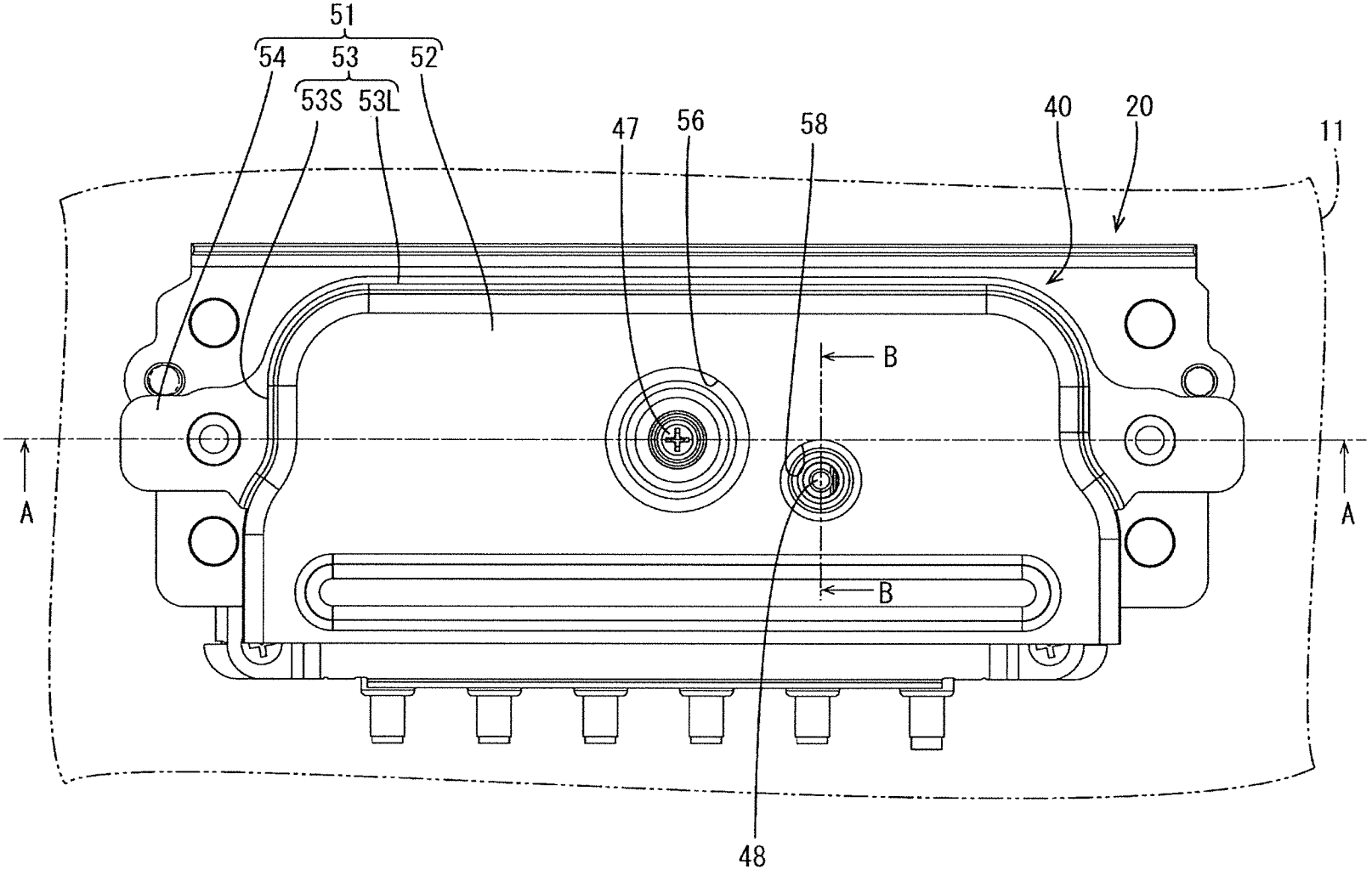
FIG. 1 is a plan view showing a device case and a seal cover mounted on this device case in an embodiment.

An embodiment is described with reference to FIGS. 1 to 4. A seal cover 40 of this embodiment is to be mounted on a device case 10 that accommodates a device inside.

[Device Case 10]

The device case 10 is a case installed in a vehicle and accommodates a device, such as a motor or an inverter. This device case 10 is a box with an electromagnetic shielding function and includes, as shown in FIGS. 2 and 4, a case wall 11 made of metal and separating internal and external spaces and a shield connector 20 to be mounted on this case wall 11.

The case wall 11 includes a connector mounting hole 12 penetrating from an inwardly facing surface to an outwardly facing surface of the device case 10, and the shield connector 20 is assembled with the case wall 11 while being aligned with the connector mounting hole 12.

Figure 2:
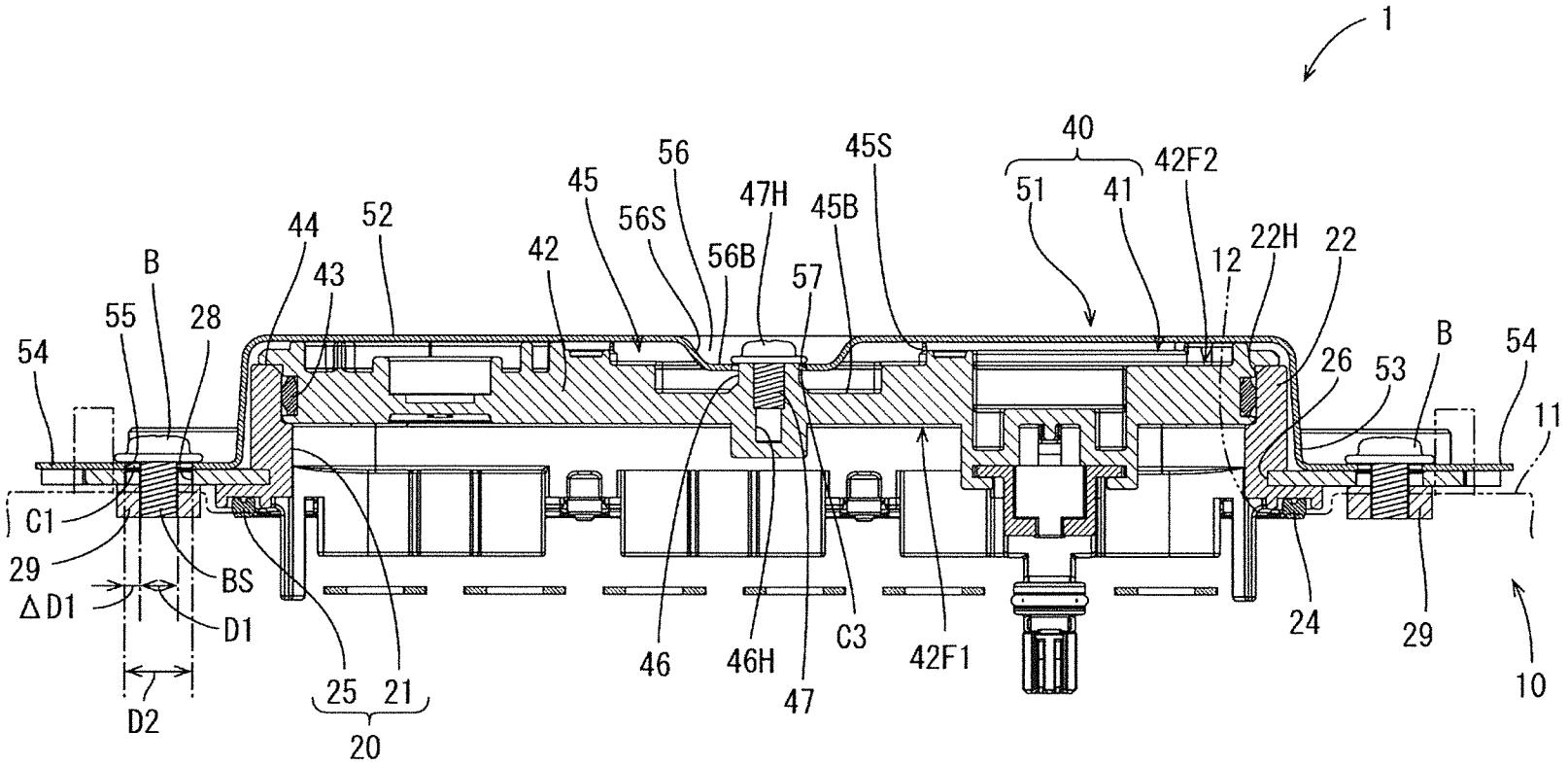
FIG. 2 is a section along A-A of FIG. 1.
Figure 4:
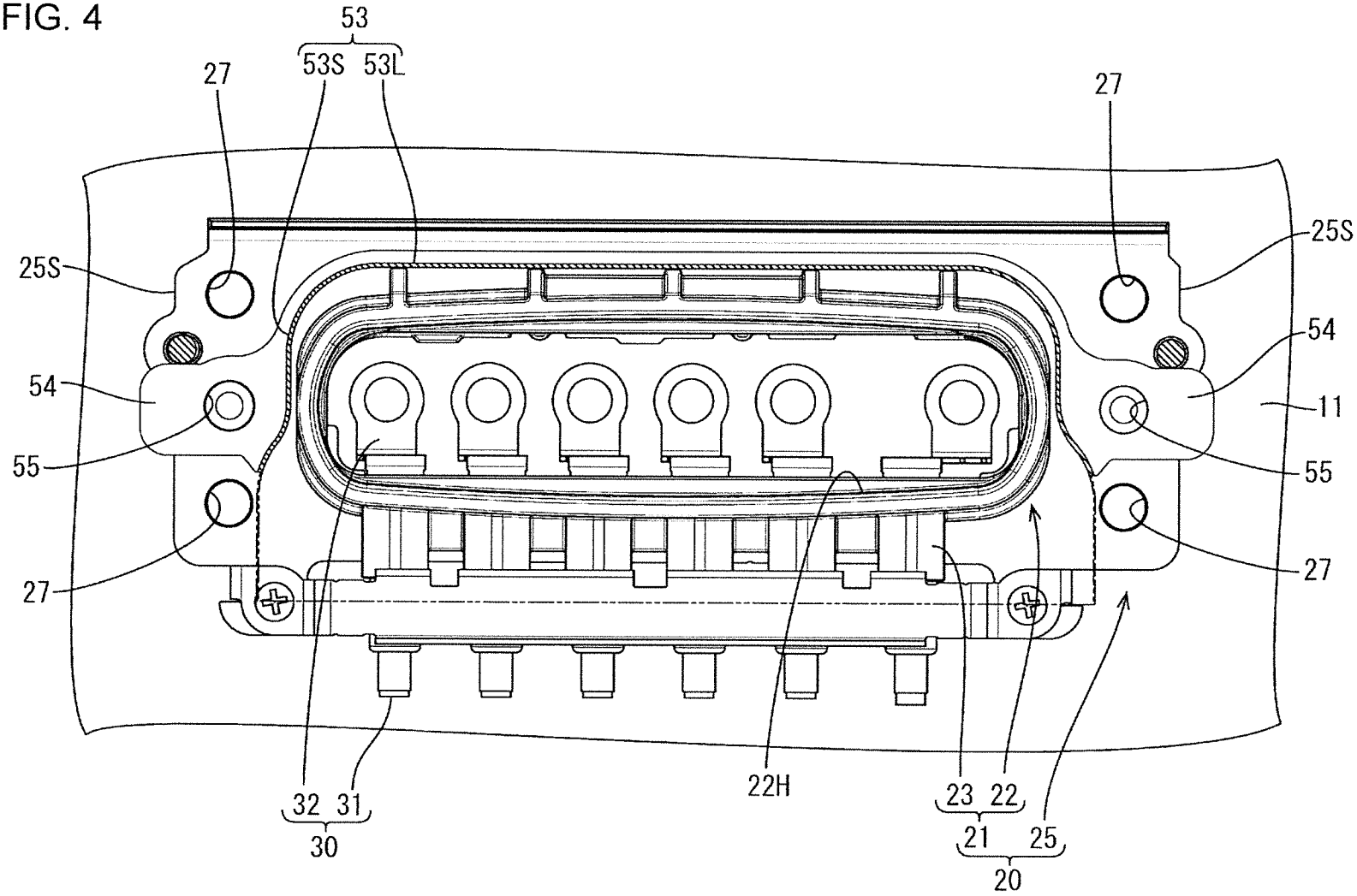
FIG. 4 is a plan view partly in section showing the seal cover mounted on the device case in the embodiment.

As shown in FIGS. 2 and 4, the shield connector 20 includes a housing 21 for holding wires with terminals 30, and a fixing plate 26.

Each of the wires with terminals 30 has a general configuration that a terminal fitting 32 is connected to an end of a wire 31.

The housing 21 is made of synthetic resin and includes, as shown in FIG. 4, a receptacle 22 and wire holding portions 23. The receptacle 22 is a tubular part having openings on both ends, as shown in FIGS. 2 and 4. Each of the wire holding portions 23 is a hollow cylindrical part extending out from the outer peripheral surface of the receptacle 22. An end part of the wire 31 and one end part of each terminal fitting 32 connected to this wire 31 are arranged inside each wire holding portion 23. The other end part of each terminal fitting 32 penetrates through a tubular wall of the receptacle 22 to project into the receptacle 22.

An upper opening of the receptacle 22 in FIG. 2 serves as a work opening 22H into which a worker inserts his hand to perform an operation when the device accommodated inside the device case 10 and the terminal fittings 32 are connected. When the connecting operation is not performed, this work opening 22H is closed by the seal cover 40.

The fixing plate 25 is made of metal and, as shown in FIG. 4, is substantially rectangular. This fixing plate 25 includes a housing mounting hole 26 and six bolt insertion holes 27, 28.

As shown in FIG. 2, the housing mounting hole 26 penetrates from one plate surface to the other plate surface of the fixing plate 25. A part of the fixing plate 26 around the housing mounting hole 26 is embedded in the receptacle 22, and the fixing plate 26 is fixed to the housing 21 in a state where an outer peripheral part excluding this embedded part projects out from the outer periphery of the receptacle 22.

Three, out of the six bolt insertion holes 27, 28, are arranged side by side along a first short side 25S of the fixing plate 25, and the remaining three are arranged along the second short side 25S. Out of the three bolt insertion holes 27, 28 arranged along the first short side 25S, two on both ends are first bolt insertion holes 27 (see FIG. 4) and one in the middle is a second bolt insertion hole 28 (see FIG. 2). The first bolt insertion holes 27 receive plate fixing bolts (not shown) for fixing the fixing plate 25 to the case wall 11, and the second bolt insertion hole 28 receives a shell fixing bolt B for fixing the seal cover 40 to the fixing plate 25. As shown in FIG. 2, nuts 29 to be screwed onto the shell fixing bolts B are fixed on a surface of the fixing plate 25 facing the case wall 11. The nuts 29 are arranged concentrically with the second bolt insertion holes 28.

As shown in FIG. 2, the shield connector 20 is mounted on the case wall 11 in such a posture that the fixing plate 25 is parallel to the case wall 11. An opening edge of the receptacle 22 opposite to the work opening 22H (lower opening edge of FIG. 2) overlaps with a peripheral edge of the connector mounting hole 12 on an outer surface of the case wall 11. The plate fixing bolts are inserted through the first bolt insertion holes 27 and screwed into bolt holes (not shown) arranged in the case wall 11 to fix the shield connector 20 to the case wall 11.

As shown in FIG. 2, a first sealing member 24 is disposed between the receptacle 22 and the case wall 11. A clearance between the receptacle 22 and the case wall 11 is sealed by sandwiching this first sealing member 24 by the receptacle 22 and the case wall 11.

[Seal Cover 40]

The seal cover 40 closes the work opening 22H by being assembled with the shield connector 20. As shown in FIG. 2, the seal cover includes a cover body 41 and a shield shell 51. The cover body 41 is to be fit into the receptacle 22. The shield shell 51 (equivalent to a covering member) is made of metal and is to be assembled with the cover body 41.

The cover body 41 is made of synthetic resin and includes a fitting 42, a flange 44, a boss 46 and a restricting protrusion 48 (equivalent to an engaging protrusion).

As shown in FIG. 2, the fitting 42 is a block to be fit into the receptacle 22. A second sealing member 43 is disposed on the outer peripheral surface of the fitting 42. A clearance between the outer peripheral surface of the fitting 42 and the inner peripheral surface of the receptacle 22 is sealed by this second sealing member 43. The fitting 42 has a fitting surface 42F1 facing inwardly of the device case 10 and a shell fixing surface 42F2 facing outwardly of the device case 10 when the fitting 42 fit in the receptacle 22.

As shown in FIG. 2, the flange 44 projects out from the outer peripheral surface of the fitting 42, and is in proximity to the shell fixing surface 42F2. With the seal cover 40 assembled with the housing 21, the flange 44 is in contact with the opening edge of the work opening 22H in the receptacle 22 so that the cover body 41 is positioned with respect to the housing 21.

A shell mounting recess 45 and the boss 46 and the restricting protrusion 48 arranged inside this shell mounting recess 45 are arranged on the shell fixing surface 42F2.

As shown in FIG. 2, the shell mounting recess 45 is circular and is recessed from the shell fixing surface 42F2. The shell mounting recess 45 has a circular bottom surface 45B that extends parallel to the shell fixing surface 42F2 and is formed with a hole. A side surface 45S is continuous from this bottom surface 45B to the shell fixing surface 42F2 and has a step. The shell mounting recess 45 is substantially in a center of the shell fixing surface 42F2.

The boss 46 is a cylindrical part arranged in the center of the shell fixing surface 42F2 and extends perpendicularly from the shell fixing surface 42F2. The boss 46 has a lower hole 46H that is open in a projecting end surface of the boss 46 for receiving a tap screw 47 for fixing the shield shell 51 to the cover body 41.

Figure 3:
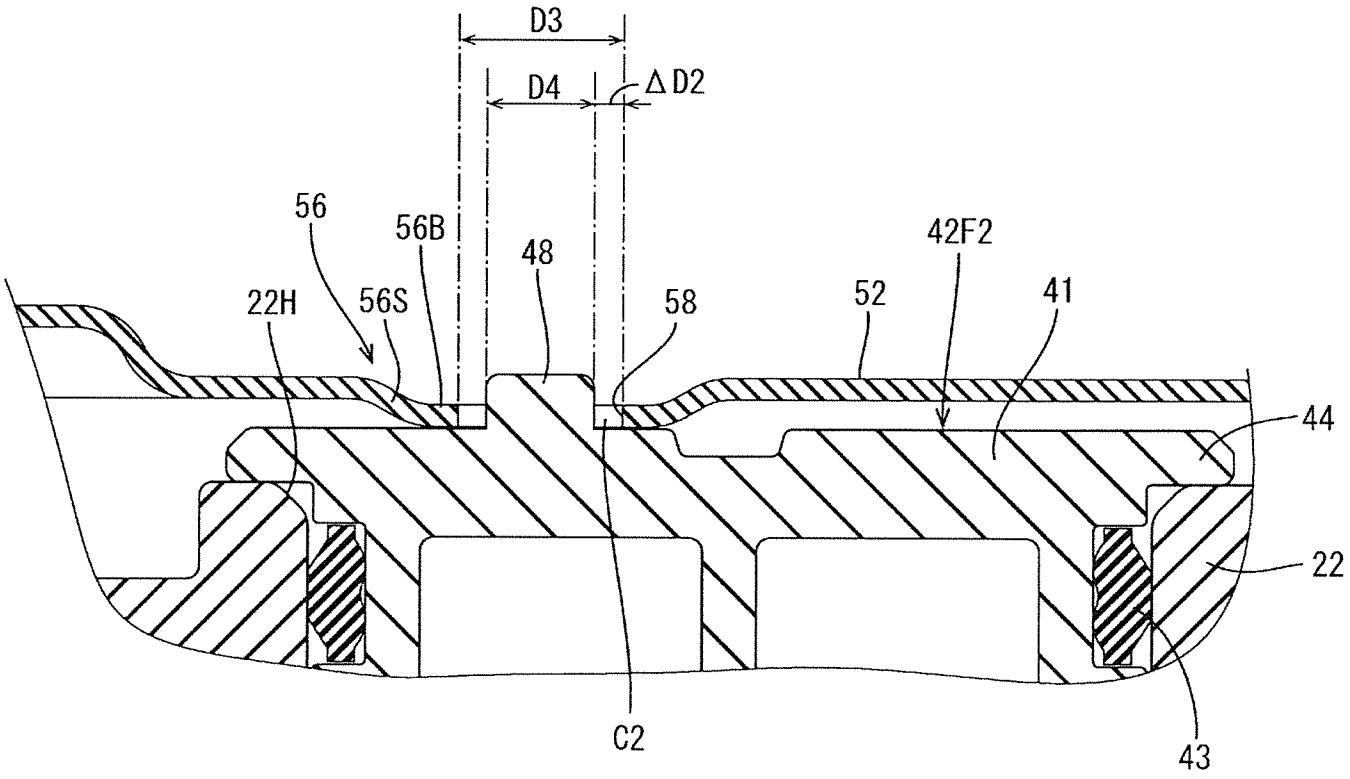
FIG. 3 is a section along B-B of FIG. 1.

The restricting protrusion 48 is a cylindrical part arranged in proximity to the boss 46, as shown in FIG. 1, and extends perpendicularly from the shell fixing surface 42F2, as shown in FIG. 3.

The shield shell 51 is a tray-like member formed by press-working a metal plate material and, as shown in FIG. 2, is formed to be slightly larger than the cover body 41 so that the shield shell 51 can cover the cover body 41 from the outside. As shown in FIG. 1, the shield shell 51 includes a main plate 52, a side plate portion 53 continuous from the main plate 52 and two mounting plates 54 continuous from the side plate 53.

As shown in FIG. 1, the main plate 52 is a rectangle that is slightly larger than the shell fixing surface 42F2 and is parallel to the shell fixing surface 42F2. As shown in FIG. 2, the side plate portion 53 is extending perpendicular to the main plate 52 from a peripheral edge of the main plate 52 and surrounds the cover body 41 on three sides. As shown in FIG. 4, the side plate portion 53 includes a long side plate 53L extending from one of two long sides of the main plate 52 and two short side plates 53S extending from two short sides of the main plate 52.

Each of the two mounting plates 54 extends out from each of the two short side plates 53S. Each mounting plate 54 is continuous from an end edge of each of the two short side plates 53S opposite to the main plate 52, as shown in FIG. 2, and projects from a middle position between the two long sides of the main plate 52, as shown in FIG. 4. Each mounting plate 54 includes a third bolt insertion hole 5, and a shell fixing bolt 54 can be inserted through the third bolt insertion hole 55 for fixing the seal cover 40 to the fixing plate 25, as shown in FIG. 2. The third bolt insertion hole 55 is a circular hole penetrating through the mounting plate 54 and has an inner diameter D2 larger than an outer diameter D1 of a shaft BS of the shell fixing bolt B.

The main plate 52 includes a screw accommodation recess 56, a boss insertion hole 57 and a restricting hole 59 (equivalent to an engaging hole) arranged in the screw accommodation recess 56.

As shown in FIG. 2 the screw accommodation recess 56 is a circular recess that is recessed in from the main plate 52. The screw accommodation recess 56 is defined by a bottom wall 56B that is parallel to the main plate 52 and a side wall 56S that extends obliquely from a periphery of the bottom wall 56B and continuous from the main plate 52. This screw accommodation recess 56 is located substantially at a center of the main plate 52 between the mounting plates 54, as shown in FIG. 1.

As shown in FIG. 2, the boss insertion hole 57 through which the boss 46 is inserted is arranged in the screw accommodation recess 56. The boss insertion hole 57 is a circular hole penetrating through the bottom wall 56B and has an inner diameter larger than an outer diameter of the boss 46 and smaller than an outer diameter of a head 47H of the tap screw 47.

As shown in FIG. 3, the restricting hole 58 is circular and penetrates through the main plate portion 52 for receiving the restricting protrusion 48. The restricting hole 58 has an inner diameter D3 larger than an outer diameter D4 of the restricting protrusion 48. As shown in FIG. 1, this restricting hole 58 is near the screw accommodation recess 56 and slightly deviated from a line connecting the two mounting plates 54 and the boss insertion hole 57. A difference ΔD2 (see FIG. 3) between the inner diameter of the restricting hole 58 and the outer diameter of the restricting protrusion 48 is larger than a difference ΔD1 (see FIG. 2) between the inner diameter D2 of the third bolt insertion hole 55 and the outer diameter D1 of the shaft portion BS of the shell fixing bolt B.

In assembling the shield shell 51 with the cover body 41, the cover body 41 first is disposed inside the shield shell 51 while a tip part of the boss 46 is inserted through the boss insertion hole 57. At this time, if the cover body 41 is in a correct orientation with respect to the shield shell 51, the restricting protrusion 48 is received into the restricting hole 58. However, if the cover body 41 is in a wrong orientation with respect to the shield shell 51, the restricting protrusion 48 interferes with the main plate 51 and cannot be mounted.

Subsequently, the tap screw 47 is screwed into the lower hole 46H of the boss 46 to fix the shield shell 51 to the cover body 41. At this time, an internal thread is formed in the lower hole 46H by a screw part of the tap screw 47.

The boss insertion hole 57 has the inner diameter larger than the outer diameter of the boss 46 and smaller than the outer diameter of the head 47H of the tap screw 47. Thus, the head 47H of the tap screw 47 is locked to an edge of the boss insertion hole 57 while coming into contact with a projecting end surface of the boss 46 to fix the shield shell 51 to the cover body 41. Further, the boss 46 is inserted with a clearance C3 defined between the boss 46 and an edge of the boss insertion hole 57. Further, the restricting hole 58 has the inner diameter D3 larger than the outer diameter D4 of the restricting protrusion 48 and the restricting protrusion 48 is inserted with a clearance C2 (equivalent to a second clearance) defined between the restricting protrusion 48 and an edge of the restricting hole 58. In this way, the shield shell 51 is held displaceably in all directions parallel to the plate surfaces of the main plate 52 and all directions perpendicular to the plate surfaces of the main plate 52 (directions along an extending direction of the boss 46) with respect to the cover body 41.

[Assembling of Seal Cover 40 with Device Case 10]

In assembling the seal cover 40 with the device case 10, the seal cover 40 is pressed toward the shield connector 20 and the fitting 42 is pushed into the receptacle 22 through the work opening 22H. With the fitting 42 and the receptacle 22 fit, the work opening 22H is closed and a clearance between the outer peripheral surface of the fitting 42 and the inner peripheral surface of the receptacle 22 is sealed by the second sealing member 43. After the fitting of the fitting portion 42 and the receptacle 22 is completed, the shell fixing bolts B are inserted through the third bolt insertion holes 55 and screwed into the nuts 29 to fix the shield shell 51 to the fixing plate 25.

The shield shell 51 is held displaceably with respect to the cover body 41 as described above. Thus, assembling tolerances of the shield shell 51, the cover body 41 and the receptacle 22 can be absorbed.

Further, the third bolt insertion hole 55 has the inner diameter D2 larger than the outer diameter D1 of the shaft BS of the shell fixing bolt B. Thus, the shaft BS is inserted with a clearance C1 (equivalent to a first clearance) defined between the shaft BS and an edge of the third bolt insertion hole 55. In this way, position tolerances of the nut 29 and the third bolt insertion hole 55 are absorbed. However, the shield shell 51 is displaceable along a plate surface direction of the fixing plate 25 due to the presence of the clearance C1. Therefore, the shield shell 51 may rotate about the boss 46 as the shell fixing bolt B is rotated when the shell fixing bolt B is tightened.

The shield shell 51 is held displaceably with respect to the cover body 41, as described above. Thus, the cover body 41 does not easily rotate even if the shield shell 51 rotates. However, if the edge of the restricting hole 58 comes into contact with the restricting protrusion 48 as the shield shell 51 rotates, the cover body 41 may rotate. If the orientation of the fitting portion 42 with respect to the receptacle 22 is deviated by the rotation of the cover body 41, a strong compressive force is applied locally to the second sealing member 43 and sealability may be reduced.

Accordingly, in this embodiment, the size of the clearance C2 is set such that the restricting protrusion 48 does not contact the edge of the restricting hole 58 even if the shield shell 51 rotates. Specifically, the difference ΔD2 between the inner diameter D3 of the restricting hole 58 and the outer diameter D4 of the restricting protrusion 48 is larger than the difference ΔD1 between the inner diameter D2 of the third bolt insertion hole 55 and the outer diameter D1 of the shaft BS of the shell fixing bolt B, thereby making the clearance C2 larger than the clearance C1. According to this configuration, even if the shield shell 51 rotates until the shaft BS of the shell fixing bolt B contacts the edge of the third bolt insertion hole 55, the restricting protrusion 48 does not contact the edge of the restricting hole 58. If the shaft BS of the shell fixing bolt B contacts the edge of the third bolt insertion hole 55, any further rotation of the shield shell 51 is restricted. Thus, there is no possibility that the restricting protrusion 48 contacts the edge of the restricting hole 58 to rotate the cover body 41. In this way, the rotation of the cover body 41 together with the shield shell 51 is restricted and a reduction of sealability due to local compression of the second sealing member 43 is suppressed.

As described above, the seal cover 40 includes the case wall 11 and the shield connector 20 to be mounted on this case wall 11 and is mounted on the device case 10. The shield connector 20 includes the receptacle 22 having the work opening 22H, and the seal cover 40 closes this work opening 22H. The seal cover 40 includes: the cover body 41 to be fit to the receptacle 22; the second sealing member 43 for sealing between the cover body 41 and the inner peripheral surface of the receptacle 22 by being mounted on the cover body 41; the shield shell 51 for covering the cover body 41 and the receptacle 22 by being assembled with the cover body 41; and the shell fixing bolts B for fixing the shield shell 51 to the shield connector 20. The shield shell 51 includes the third bolt insertion holes 55 through which the shell fixing bolts B are inserted, and the shell fixing bolts B are inserted with the clearances C1 defined between the shell fixing bolts B and the hole edges of the third bolt insertion holes 55. Further, the cover body 41 includes the restricting protrusion 48, the shield shell 51 includes the restricting hole 58 and the restricting protrusion 48 is inserted with the clearance C2 defined between the restricting protrusion 48 and the edge of the restricting hole 58. The size of the clearance C2 is set such that the restricting protrusion 48 does not come into contact with the edge of the restricting hole 58 even if the shield shell 51 rotates as the shell fixing bolt B is tightened.

There may be position tolerances between the third bolt insertion holes 55 provided in the shield shell 51 and the nuts 29 provided on the shield connector 20 and having the shell fixing bolts B screwed therein. To absorb these position tolerances, the shell fixing bolts B are inserted with the clearances C1 defined between the shell fixing bolts B and the edges of the third bolt insertion holes 55 in the seal cover 40. However, the shield shell 51 may rotate together with the rotation of the shell fixing bolt B in tightening the shell fixing bolt B due to the presence of the clearance C1. If the restricting protrusion 48 comes into contact with the edge of the restricting hole 58 as the shield shell 51 rotates, the cover body 41 rotates and a strong compressive force is applied locally to the second sealing member 43 so that may be reduced.

Accordingly, in the seal cover 40 of this embodiment, the size of the clearance C2 is set such that the restricting protrusion 48 does not contact the edge of the restricting hole 58 even if the shield shell 51 rotates. This suppresses the rotation of the cover body 41 together with the shield shell 51 and suppresses a reduction of sealability due to local compression of the second sealing member 43.

The invention is not limited to the above described and illustrated embodiment. For example, the following modes also are included.

Although the cover body 41 includes the restricting protrusion 48 and the shield shell includes the restricting hole 58 in the above embodiment, a shield shell may include an engaging protrusion and a cover body may include an engaging hole.

Although each of the pair of mounting plates 54 is continuous from each of the two short side plates in the above embodiment, a mounting plate portion may be, for example, continuous from a long side plate.

LIST OF REFERENCE SIGNS

10 . . . device case (case)
22 . . . receptacle
22H . . . work opening (opening)
40 . . . seal cover
41 . . . cover body
43 . . . second sealing member
48 . . . restricting protrusion (engaging protrusion)
51 . . . shield shell (covering member)
55 . . . third bolt insertion hole (bolt insertion hole)
58 . . . restricting hole (engaging hole)
B2 . . . shell fixing bolt (bolt)
C1 . . . clearance (first clearance)
C2 . . . clearance (second clearance)

The invention claimed is:

1. A seal cover for closing an opening by being mounted on a case having the opening; comprising:

a cover body for closing the opening;

a sealing member for sealing between the cover body and the case by being mounted on the cover body;

a covering member for covering the cover body by being assembled with the cover body; and a bolt for fixing the covering member to the case;

the covering member including a bolt insertion hole through which the bolt is inserted, the bolt being inserted in the bolt insertion hole with a first clearance defined between the bolt and a hole edge of the bolt insertion hole;

one of the cover body and the covering member including an engaging protrusion and the other including an engaging hole for receiving the engaging protrusion, the engaging protrusion being inserted in the engaging hole with a second clearance defined between the engaging protrusion and a hole edge of the engaging hole;

the size of the second clearance being set such that the engaging protrusion does not come into contact with the hole edge of the engaging hole even if the covering member rotates as the bolt is tightened.

2. The seal cover of claim 1, wherein the second clearance is larger than the first clearance.

* * * * *